United States Patent [19]

Shimizu

[11] 4,208,046

[45] Jun. 17, 1980

[54] SHEET FEEDING ASSEMBLY

[75] Inventor: Masahiro Shimizu, Kashihara, Japan

[73] Assignee: Sharp Kabushiki Kaisha, Osaka, Japan

[21] Appl. No.: 942,354

[22] Filed: Sep. 14, 1978

[30] Foreign Application Priority Data

Sep. 16, 1977 [JP] Japan ..... 52-125508

[51] Int. Cl.[2] ..... B65H 3/06; B65H 3/46

[52] U.S. Cl. ..... 271/122; 271/125

[58] Field of Search ..... 271/121, 122, 124, 125

[56] References Cited

U.S. PATENT DOCUMENTS 2,922,643 1/1960 Lopez ..... 271/125 X

FOREIGN PATENT DOCUMENTS 628694 10/1961 Canada ..... 271/36

OTHER PUBLICATIONS

V. J. Falcone; "Document Separator", IBM Technical Disclosure Bulletin; vol. 4, No. 4; 9–1969; 1 page.

*Primary Examiner*—Robert W. Saifer

*Attorney, Agent, or Firm*—Birch, Stewart, Kolasch & Birch

[57] ABSTRACT

A sheet feeding assembly for separating and feeding sheet material one by one by means of a reversely rotatable separation roller or a stationary friction separation roller. There is further provided a sheet protective roller of which the dimension is substantially equal to that of the separation roller. The protective roller is rotatable freely from the separation roller so that the relative movement of the protective roller may remain unchanged with respect to the feed roller when in use.

7 Claims, 2 Drawing Figures

SHEET FEEDING ASSEMBLY

The present invention relates to a sheet feeding assembly, and more particularly to a sheet feeding assembly for separating and feeding sheet material one by one by means of a reversely rotatable separation roller or a stationary friction separation roller.

The virtually important and inherent functions of a sheet feeding assembly for use in facsimile facilities, optical character readers or the like are to separate and feed sheet material one by one and enhance durability without impairing sheet material.

It is therefore an object of the present invention to provide a sheet feeding assembly which fulfills the above described requirements satisfactorily. According to one aspect of the present invention, there is provided a reversely rotatable separation roller or a stationary friction separation roller in the spaced relation with respect to a feed roller connected to a driving source. When in use, the separation roller is varied in the relative movement with respect to the working feed roller. There is further provided a sheet protective roller of which the dimension is substantially equal to that of the separation roller. The protective roller is rotatable freely from the separation roller so that the relative movement of the protective roller may remain unchanged with respect to the feed roller when in use. It is preferable that a pair of the protective roller be located at both sides of the separation roller.

Figure 1:
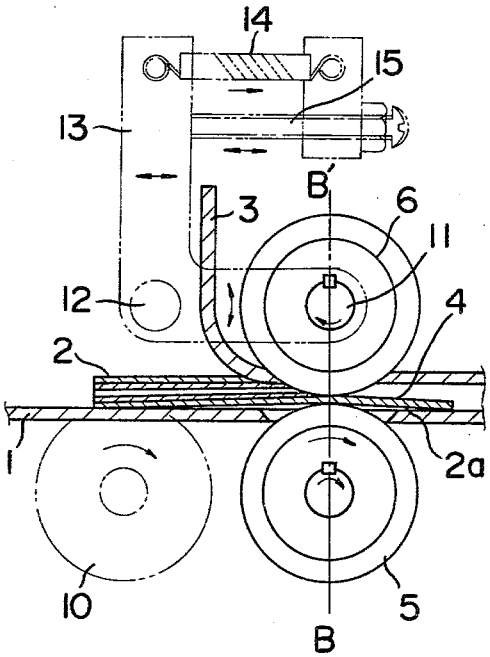
Figure 2:
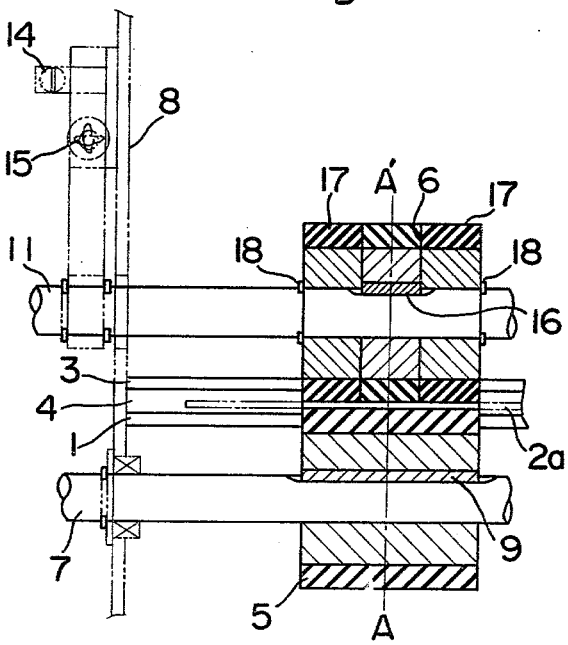

Other objects and many of the attendant advantages of the present invention will be readily appreciated as the same becomes better understood by reference to the following detailed description when considered in conjunction with the accompanying drawings, and wherein:

FIG. 1 is a side view of a sheet material feeding assembly embodying the present invention; and FIG. 2 is a cross sectional view of the sheet material feeding assembly taken along the line B—B of FIG. 1.

Referring now to FIG. 1, there is illustrated one preferred form of the present invention. A stack of multiple sheets 2 is disposed on a hopper base 1, with the leading edge thereof constrained by a sheet guide 3. Adjacent an outlet 4 for the sheet 2 defined by the guide 3 and the hopper base 1 there are provided a feed roller 5 and a separation roller 6 in a face to face relationship.

The feed roller 5 is disposed to facilitate rotation in the direction of the motion of the sheets 2 on an apparatus frame by any suitable means its shaft 7 is journaled at the opposite ends thereof within suitable bearings. The feed roller 5 is fixed relative to the shaft with the aid of a fastener pin 9. A driven roller 10 which is similar to the feed roller 5 is provided in a position to abut the lowest of the stacked sheets 2 within the hopper. An "L" shaped adjustment arm 13 is secured to swing about its pivot 12, which carries on its one end the separation roller 6 whether rotatable or stationary. The opposite end of the adjustment arm 13 is urged by a coil spring 14 in a sense to direct the separation roller 6 toward the feed roller. One end of the coil spring 14 is fixed to a frame 8. An adjustment screw 15 is provided such that a spacing between the separation roller 6 and the feed roller 5 is adjustable against the urging force of the adjustment arm 13.

By virtue of the adjustment screw 15, the adjustment arm 13 is displaced to the extent that the roller-to-roller spacing agrees with the thickness of the sheets 2. This makes it possible to separate and feed one by one the sheets 2 with an extremely thin thickness and small rigidity against bending.

In the event any of the sheets 2 having a thickness a little thicker than the given roller-to-roller spacing comes into contact with the driven roller 10, the sheet forwarding force of the driven roller 10 and the feed roller 5 will surpass the spring force of coil spring 14, displacing the separation roller 6 upwardly and lengthening the roller-to-roller spacing. Subsequently, the original roller-to-roller spacing will be restored by the action of the spring 14.

As noted earlier, the separation roller 6 may be of the stationary friction type. In this case, the shaft 11 of the separation roller 6 is tightly secured to the adjustment arm 13 not to rotate. In contrast, for the reversely rotatable type separation roller 6, the shaft 11 is secured via a unidirectional clutch to the adjustment arm 13 to rotate in the direction opposite to movement of the sheets. The separation roller 6 itself is held on the shaft 11 by a fastener pin 16. It will be understood that the separation roller 6 is varied in the relative movement with respect to the working feed roller whether rotational or stationery. One or two sheet protective rollers 17 which play an important role in the present invention are provided at opposite ends of the separation rollers 17 to rotate freely from movement of the shaft 11. Therefore, when in use, the protective rollers 17 may rotate with movement of the feed roller 5 rather than movement of the separation roller 6. A stop 18 arrests undesirable axial movement of the protective rollers 17. The dimension of the protective rollers 17 is equal to or slightly smaller than the dimension of the protective rollers 17. The feed roller 5, the separation roller 6 and the protective rollers 17 are made of metallic material overlaid with resilient material.

With such an arrangement, the plurality of the sheets are separated one by one in the following manner. The sheets 2, 2*a* are in part propelled to reach between the feed roller 5 and the separation roller 6 by the driven roller 10. The lowest of the sheets 2*a* is given forward force from below due to friction of the sheets 2*a* and the driven roller 10 and the feed roller 5. At the same time, friction between the separation roller 6 and the sheet 2*a* creates backward force from above and friction between the protective roller 17 and the sheet 2*a* creates backward force corresponding to inertia of the protective roller 17. In the event that the forward force is greater than the backward force, the sheet 2*a* will be advanced correspondingly. As soon as the lowest of the sheet 2*a* is advanced in this way, the second lowest of the sheet 2 will be given the forward force. Provided, however, that friction between the separation roller 6 and the protective roller 17 is greater than the forward force of the sheet 2*a* due to friction, the second lowest one will be blocked at the separation roller 6 at this moment. As a result, the lowest sheet 2*a* is clearly separated from the upper sheet 2 and advanced, whereby the plurality of the sheets are one-by-one separated.

The function of the protective roller 17 is to protect the sheet 2 against overload. On the way where the sheet 2*a* reaches between the feed roller 5 and the separation roller 6 for feeding purposes, the separation roller 6 is displaced upwardly in accordance with the thickness of the sheet 2*a*, establishing a desired spacing. After completing the feeding operation, the separation roller 6 will be restored to its original position. When lifting the separation roller 6, the sheet 2*a* stands in the feeding state so that the leading edge of the sheet 2a in contact with the separation roller 6 and the protective roller 17 bears a load in the forward direction tending to bend the sheet 2a. The bending of the sheet 2a is due to involvement of the forward force afforded to the sheet 2a by the driven roller 10 and the feed roller 5, the backward force afforded by the separation roller 6 and the sheet 2a and the backward force by inertia of the protective roller 17. In this case such bending stress or load is not concentrated on the separation roller 6 but received by the contacting components inclusive of the protective roller 17, thereby distributing stress produced on the leading edge of the sheet 2a. This means that the sheet 2a is afforded rigidity against bending.

When the sheet 2 is not being supplied, the protective roller 17 is reversely rotated in case of the reversely rotatable separation roller or stationary in case of the stationary friction roller. The leading edge of the sheet 2a travels ahead due to inertia of the protective roller. Thereafter, the protective roller 17 itself is afforded the forward force. In this way, the protective roller 17 gives an inertia load for a moment and then serves as a guide roller during the sheet feed state. This prevents a damage such as a wrinkle and a rip and a jam due to bending of the sheets.

While the sheets are being fed one by one, the second lowest of the sheets 2 is blocked by the protective roller 17 and ready for the next sheet feeding operation. The sheet 2 suffers from bending stress constantly under these circumstances. As noted above, in the event that the stress acts upon only the separation roller 6, there is a possibility of impairing the sheet 2 and experiencing a jam problem. Nevertheless, according to the present invention, the function of the protective roller 17 urges the sheet 2 against the hopper base 1 from above and affords rigidity against bending to the sheet 2. While in the past a guide 3 was supposed to prevent the jam problem due to damage or bending of the sheets, it was not able to enhance rigidity. Because the guide 3 was located against the base 1 with a spacing corresponding to the possible maximum thickness of the sheets 2 and lacked satisfactory tolerance for a wide range of variations in the thickness of the sheets.

By providing the freely rotatable sheet protective rollers at both sides of the reversely rotatable separation roller or the stationary friction separation roller, a force of separation due to inertia of the protective roller is allowed to exert upon the sheets for a moment, thereby surely separating the plurality of the sheets.

After the protective roller has exhausted the inertia force, this serves the purpose of a guide roller so that the feeding assembly is free of damage and jam problems. Moreover, since the sheets are coplanar with the roller in operation, durability of the separation roller is enhanced and the contacting area of the sheets is enlarged. The protective roller which rotates in the forward direction due to friction with the sheets, ensures rigidity of the sheets against bending and makes it possible to separate extremely thin sheets one by one.

As described above, the separation roller and the sheet protective roller are provided coaxially and with substantially the same diameter, thereby allowing different thickness sheets to be separated and supplied one by one.

The invention being thus described, it will be obvious that the same may be varied in many ways. Such modifications are not to be regarded as a departure from the spirit and scope of the invention, and all such modifications are intended to be included within the scope of the following claims.

I claim:

1. A sheet feeding assembly for feeding sheet material from a stack, in single sheets comprising:

feed roller means for feeding the sheets sequentially;

a shaft;

separation roller means fixed to said shaft at a predetermined distance from said feed roller means for separating single sheets from the stack;

sheet protecive roller means for preventing sheet damage mounted coaxially on said shaft with said separation roller means and capable of rotation independently from said shaft; and axial movement prevention means for retaining said sheet protective roller means in axial engagement to said separation roller means;

wherein said sheet protective roller means is slidably engaged with said separation roller means so that when a sheet initially contacts said sheet protective roller means and said separation roller means, said sheet protective roller means resists the movement of the sheet due to inertial effects; and wherein these inertial effects are quickly overcome by the force moving the sheet so that said protective roller means rotates to aid the movement of the sheet and to prevent the sheet from bending.

2. The sheet feeding assembly as defined in claim 1 wherein said sheet protective roller means comprises two sheet protective rollers mounted on opposite sides of said separation roller means.

3. The sheet feeding assembly as defined in claim 1 wherein said separation roller means does not rotate.

4. The sheet feeding assembly of claim 1 wherein said separation roller means rotates in a direction to oppose the paper feed.

5. The sheet feeding assembly of claim 1 wherein the predetermined distance between said separation roller means and said feed roller means varies during operation.

6. The sheet feeding assembly of claim 1 wherein said sheet protective roller is substantially the same diameter as said separation roller means.

7. A sheet feeding assembly for feeding sheet material from a stack in single sheets comprising:

feed roller means for feeding the sheets sequentially;

a shaft;

separation roller means fixed to said shaft at a predetermined distance from said feed roller means for separating single sheets from the stack;

sheet protective roller means for preventing sheet damage mounted coaxially on said shaft with said separation roller means and capable of rotation independently from said shaft; and axial movement prevention means for retaining said sheet protective roller means in axial engagement to said separation roller means;

an adjustment arm attached to said shaft, said adjustment arm being L-shaped and having a corner and first and second ends, said shaft being attached to said adjustment arm at said first end and said adjustment arm pivoting about said corner;

a spring for biasing said separation and sheet protective rollers toward said feed roller means, said spring connected to the second end of said adjustment arm; and predetermined distance adjustment means for adjusting the predetermined distance between said separation and sheet protective roller means and said feed roller means, said predetermined distance adjustment means counting the biasing force of said spring;

wherein said sheet protective roller means is slidably engaged with said separation roller means so that when a sheet initially contacts said sheet protective roller means and said separation roller means, said sheet protective roller means resists the movement of the sheet due to inertial effects;

wherein these inertial effects are quickly overcome by the force moving the sheet so that said protective roller means rotates to aid the movement of the sheet and to prevent the sheet from bending; and wherein said sheet protective and separation roller means may be forced away from said feed roller means more than said predetermined amount when the force of said spring is overcome by a sheet thicker than said predetermined distance.

* * * * *